US011767676B2

(12) United States Patent
Bredeweg

(10) Patent No.: US 11,767,676 B2
(45) Date of Patent: Sep. 26, 2023

(54) PLANK SIDING

(71) Applicant: QUALITY EDGE, INC., Walker, MI (US)

(72) Inventor: Mark Allen Bredeweg, Zeeland, MI (US)

(73) Assignee: QUALITY EDGE, INC., Walker, MI (US)

( * ) Notice: Subject to any disclaimer, the term of this patent is extended or adjusted under 35 U.S.C. 154(b) by 0 days.

(21) Appl. No.: 17/021,501

(22) Filed: Sep. 15, 2020

(65) Prior Publication Data

US 2021/0079663 A1 Mar. 18, 2021

Related U.S. Application Data

(60) Provisional application No. 62/901,992, filed on Sep. 18, 2019.

(51) Int. Cl.
*E04F 13/12* (2006.01)
*E04F 13/08* (2006.01)

(52) U.S. Cl.
CPC ..... *E04F 13/123* (2013.01); *E04F 13/0864* (2013.01); *E04F 13/0873* (2013.01); *Y10T 29/49982* (2015.01); *Y10T 29/49995* (2015.01)

(58) Field of Classification Search
CPC ..... Y10T 29/49982; Y10T 29/49995; E04F 13/123; E04F 13/0864; E04F 13/0873; E04F 13/0846; E04F 13/0894; E04F 13/0871; E04G 21/1841; E04G 21/185; B21B 1/38
See application file for complete search history.

(56) References Cited

U.S. PATENT DOCUMENTS

| | | | | |
|---|---|---|---|---|
| 2,258,247 | A | 10/1941 | Hull | |
| 2,591,361 | A | 4/1952 | Knott | |
| 2,642,968 | A | 6/1953 | Roush et al. | |
| 3,188,774 | A | 6/1965 | McCorkle | |
| 3,325,952 | A | 6/1967 | Trachtenberg | |
| 3,473,274 | A | 10/1969 | Godes | |
| 4,102,106 | A | 7/1978 | Golder et al. | |
| 4,102,869 | A * | 7/1978 | Tobias | C08K 5/34 427/178 |
| 4,122,643 | A | 10/1978 | Hafner | |
| 4,327,528 | A | 5/1982 | Fritz | |
| 4,593,512 | A | 6/1986 | Funaki | |
| 5,016,415 | A | 5/1991 | Kellis | |
| 5,363,623 | A | 11/1994 | King | |
| 5,560,170 | A | 10/1996 | Ganser et al. | |
| 5,581,970 | A | 12/1996 | O'Shea | |
| 5,598,677 | A | 2/1997 | Rehm, III | |
| 5,694,728 | A | 12/1997 | Heath, Jr. et al. | |
| 5,862,912 | A | 1/1999 | Schelhorn | |
| 5,878,543 | A | 3/1999 | Mowery | |
| 6,223,488 | B1 | 5/2001 | Pelfrey et al. | |

(Continued)

FOREIGN PATENT DOCUMENTS

JP 2000204742 7/2000

*Primary Examiner* — Christopher J Besler
(74) *Attorney, Agent, or Firm* — PRICE HENEVELD LLP

(57) ABSTRACT

A method of painting metal coil for use in forming panels includes placing indicia on opposite sides of an image on the metal coil. The individual sections of the metal coil that include the image can be rotated 180° to create two different looking panels out of the same image on the printed metal coil.

7 Claims, 5 Drawing Sheets

(56) References Cited

U.S. PATENT DOCUMENTS

| | | | | |
|---|---|---|---|---|
| 6,295,777 | B1 | 10/2001 | Hunter et al. | |
| 6,625,939 | B1 * | 9/2003 | Beck | E04F 13/0864 52/748.1 |
| 6,988,345 | B1 | 1/2006 | Pelfrey et al. | |
| 7,040,067 | B2 | 5/2006 | Mowery et al. | |
| 7,089,709 | B2 * | 8/2006 | Waggoner | B28B 1/527 52/518 |
| 8,006,455 | B1 | 8/2011 | Mollinger et al. | |
| 8,336,269 | B1 | 12/2012 | Mollinger et al. | |
| 8,381,472 | B1 | 2/2013 | Fleenor | |
| 9,068,362 | B1 | 6/2015 | Baxter et al. | |
| 9,091,086 | B2 * | 7/2015 | Michalski | E04F 13/0894 |
| 2003/0192281 | A1 * | 10/2003 | Bullinger | B21H 8/00 52/554 |
| 2006/0053715 | A1 | 3/2006 | Mowery et al. | |
| 2006/0075712 | A1 | 4/2006 | Gilbert et al. | |
| 2008/0141607 | A1 | 6/2008 | Stoecker | |
| 2009/0126286 | A1 | 5/2009 | Sigmund et al. | |
| 2009/0282751 | A1 * | 11/2009 | Orfield | B29C 48/0022 83/13 |
| 2009/0301015 | A1 | 12/2009 | Simms | |
| 2010/0064611 | A1 | 3/2010 | Holt et al. | |
| 2015/0128422 | A1 * | 5/2015 | Rasmussen | E04D 1/265 29/897.32 |
| 2016/0153197 | A1 | 6/2016 | Baum, Jr. | |
| 2018/0133922 | A1 | 5/2018 | Herrmann et al. | |
| 2020/0392740 | A1 | 12/2020 | Bredeweg | |

* cited by examiner

PLANK SIDING

CROSS REFERENCE TO RELATED APPLICATION

Applicant hereby claims the priority benefits under the provisions of 35 U.S.C. § 119, basing said claim of priority on related U.S. Provisional Application No. 62/901,992 filed Sep. 18, 2019, which is incorporated in its entirety herein by reference.

FIELD OF THE INVENTION

The present invention relates to plank siding and, more specifically, to method of painting and forming a metal coil into plank siding.

BRIEF SUMMARY OF THE INVENTION

One aspect of the present invention includes a method of forming a siding panel. The method includes painting at least one image on a single metal coil. The method includes marking the metal coil with a first indicia on one side of the image on the metal coil and a second indicia on the opposite side of the image on the metal coil. The method includes forming the metal coil into one or more siding panels such that the first indicia is on the securing flange of some siding panels and the second indicia is on the securing flange of other siding panels.

In another aspect, the present invention includes a method of forming siding panels. The method includes painting the plurality of images on a metal coil. The metal coil is marked with a first indicia on one side of each of the plurality of images on the metal coil and a second image on the opposite side of each of the plurality of images on the metal coil. The method includes cutting the metal coil in between the first indicia of one image and a second indicia of an adjacent image to create individual pieces. The method includes roll forming the individual pieces into siding panels such that neither the first indicia nor the second indicia is on the face of the formed siding panels.

Yet another aspect of the present invention is a method of installing siding panels on a building. The method includes selecting a first siding panel having a first indicia above the face of the siding panel and a second indicia below the face of the siding panel when the siding panel is installed in a generally horizontal orientation on a building. The method includes installing the first siding panel on the wall of the building. The method includes selecting a second siding panel having a second indicia above the face of the siding panel and the first indicia below the face of the siding panel when the siding panel is installed in a generally horizontal orientation on a building. The method includes installing the second siding panel on the wall of the building.

These and other features, advantages, and objects of the present invention will be further understood and appreciated by those skilled in the art by reference to the following specification, claims, and appended drawings.

DETAILED DESCRIPTION

Figure 1:
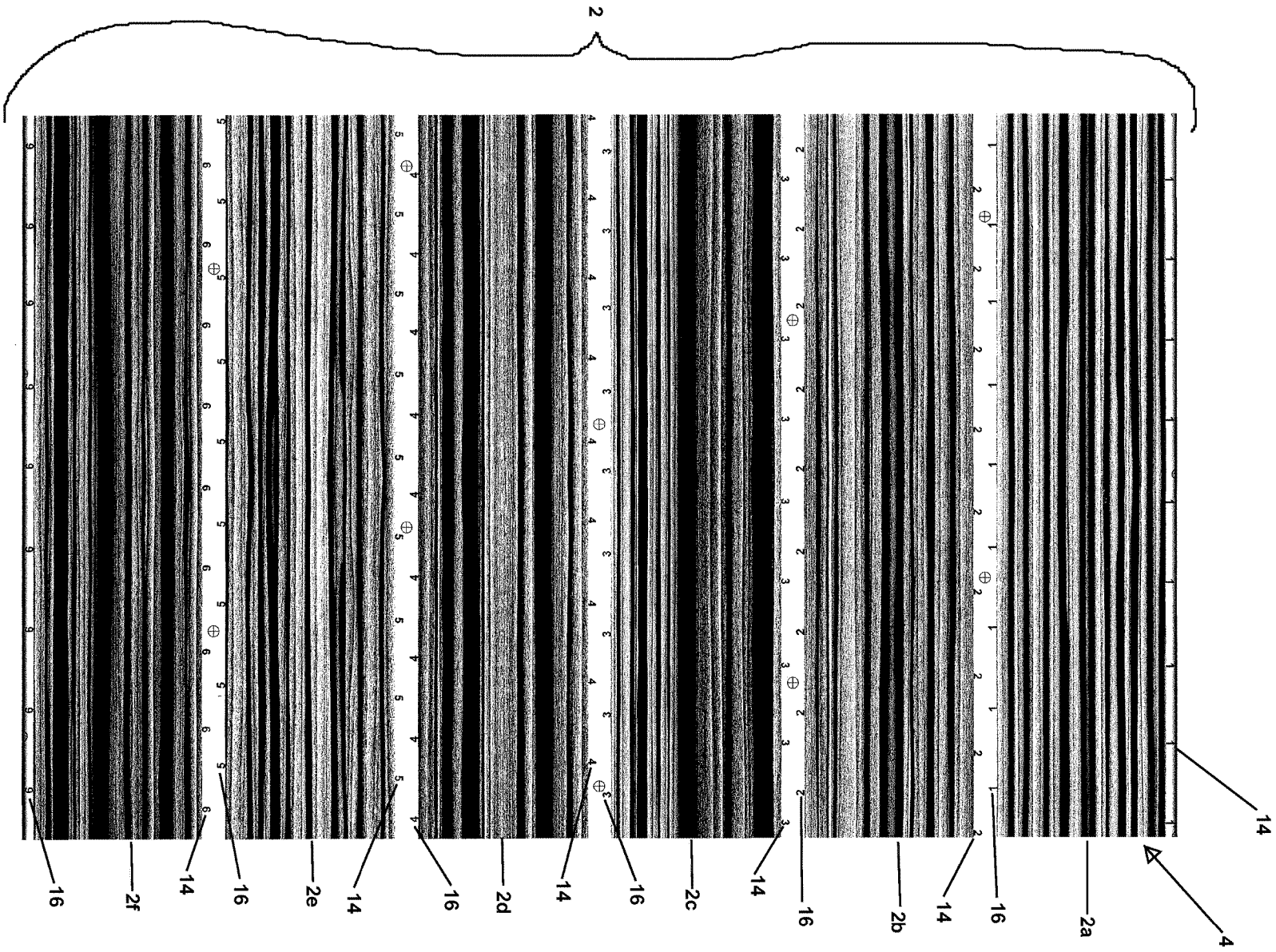
FIG. 1 is a top perspective view of an image of artwork for six different panel designs in accordance with one embodiment of the present invention.

As referenced in the figures, the same reference numerals may be used herein to refer to the same parameters and components or their similar modifications and alternatives. For purposes of description herein, the terms "upper," "lower," "right," "left," "rear," "front," "vertical," "horizontal," and derivatives thereof shall relate to the present disclosure as oriented in the Figures. However, it is to be understood that the present disclosure may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise. The drawings referenced herein are schematic and associated views thereof are not necessarily drawn to scale.

FIG. 1 illustrates an exemplary embodiment of the artwork 2 that can be used on a piece of metal coil 4. The artwork 2 that includes six different panel designs 2*a*, 2*b*, 2*c*, 2*d*, 2*e*, and 2*f*. Each of the panel designs 2*a*-2*f* includes a first indicia 14 located on one side of the image and a second indicia 16 located on the other side of the image. In the illustrated embodiment, the second indicia 16 is the mirror image of the first indicia 14. In the illustrated embodiments, the first indicia 14 and second indicia 16 are numbers. While the illustrated embodiment shown in FIG. 1 uses numbers as the indicia 14, 16, other indicia, including, but not limited to, letters, symbols, Roman numerals, etc., can be used. In addition, the second indicia 16 does not need to be the mirror image of the first indicia 14.

The artwork 2 can be used on a single piece of metal coil 4. This permits a reduction in the inventory of metal coil 4 necessary to create the multiple pieces of different looking panel designs 2*a*-2*f*. The advantage to this is a significant reduction in the amount of inventory that must be managed, consistency of the color and look of the panel designs 2*a*-2*f*, and a generally lower cost to operate because of efficiencies gained by having six distinct panel designs 2*a*-2*f* sharing a master metal coil 4. While the described embodiments utilize metal coil 4, other types of metal or other material can be used, including, but not limited to, blanks, sheets, and other types of raw material.

As can be seen on FIG. 1, the first panel design 2*a* includes the numeral 1 as the first indicia 14. The numeral 1 as a second indicia 16 is inverse with respect to the first indicia 14. When the indicia 14, 16 are inversed, it allows the indicia to be visible whether the top side or bottom side of the panel designs 2*a*-2*f* is formed as the upper portion of the panel. As illustrated in FIG. 1, the second panel design 2*b*, third panel design 2*c*, fourth panel design 2*d*, fifth panel design 2*e*, and sixth panel design 2*f* can also use similar indicia. Thus, the second panel design 2*b* utilizes the numeral 2 as the first indicia 14 and second indicia 16; the third panel design 2*c* utilizes the numeral 3 as the first indicia 14 and second indicia 16; the fourth panel design 2*d* utilizes the numeral 4 as the first indicia 14 and second indicia 16; the fifth panel design 2*e* utilizes the numeral 5 as the first indicia 14 and the second indicia 16; and the sixth panel design 2*f* utilizes the numeral 6 as the first indicia 14 and the second indicia 16.

While the embodiment of the artwork 2 illustrated in FIG. 1 uses sequential numbering as the indicia, the indicia of the different panel designs (2*a*-2*f*) does not need to be the same type of indicia or to be sequential. Moreover, as FIG. 1 illustrates six different panel designs (2*a*-2*f*) in artwork 2 applied to metal coil 4, one or more panel designs (2*a*-2*f*) can be used on a single piece of metal coil 4. For example, one or more panel designs (2*a*-2*f*) could be repeated on the same piece of metal coil 4.

In the illustrated embodiment of FIG. 1, the six panel designs (2*a*-2*f*) are painted and spaced apart such that they can be cut prior to forming. In the example illustrated of FIG. 1, the metal coil 4 width is approximately 50.25 inches, with each panel design 2*a*-2*f* being approximately 8.38 inches. The artwork 2 can be repeated continuously on the metal coil 4, and the coil 4 then cut to length, depending upon what lengths are desired.

Multiple rollers can be used in the process of painting the metal coil 4. The rollers can be used to apply portions of the length of the individual panel designs (2*a*-2*f*) and/or can be used to apply different portions of the one or more panel designs (2*a*-2*f*). For example, multiple rollers can be used to provide different coats to one or more of the individual panel designs 2*a*-2*f*. One roller can be used to provide a base coat of a generally solid color, a second roller can be used to provide a mid coat of a tone, and a third roller can be used to provide a pattern. In the illustrated examples, the third roller would provide a woodgrain pattern. However, patterns other than woodgrain can be included in addition to or in place of a woodgrain pattern. Moreover, a single roller can be used in each step of the painting process. For example, the first roller could have six spaced apart applications of similar or different colors. The second roller could have six different, spaced apart sections for the mid coat. The third roller could also have six different, spaced apart sections for the pattern. The paint can be any type of paint, ink, or other surface treatment to the metal coil 4. In addition, while a three roller paint process has been described for the illustrated artwork 2 of FIG. 1, the paint process can include one or more rollers and/or different ways of coating the metal coil 4.

Figure 2:
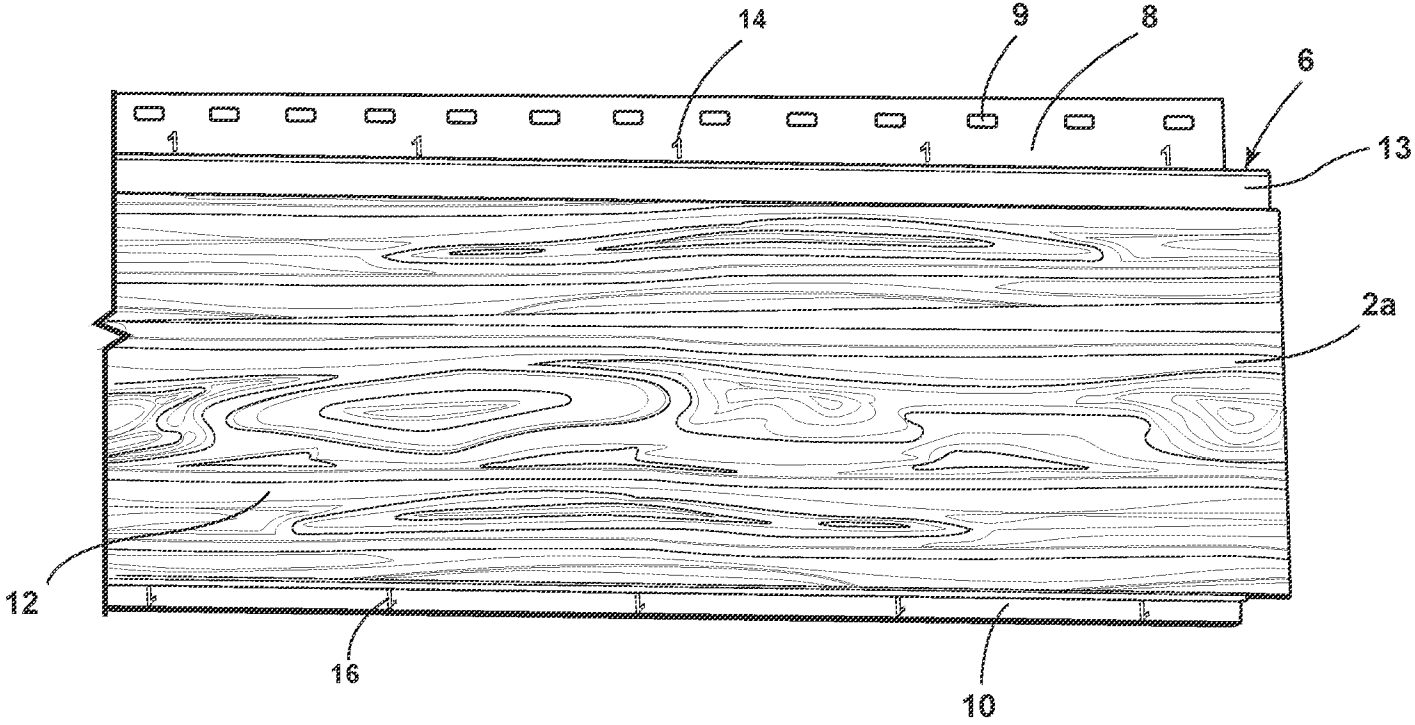
FIG. 2 is a partial front perspective view of a siding panel in an embodiment of the present invention.
Figure 3:
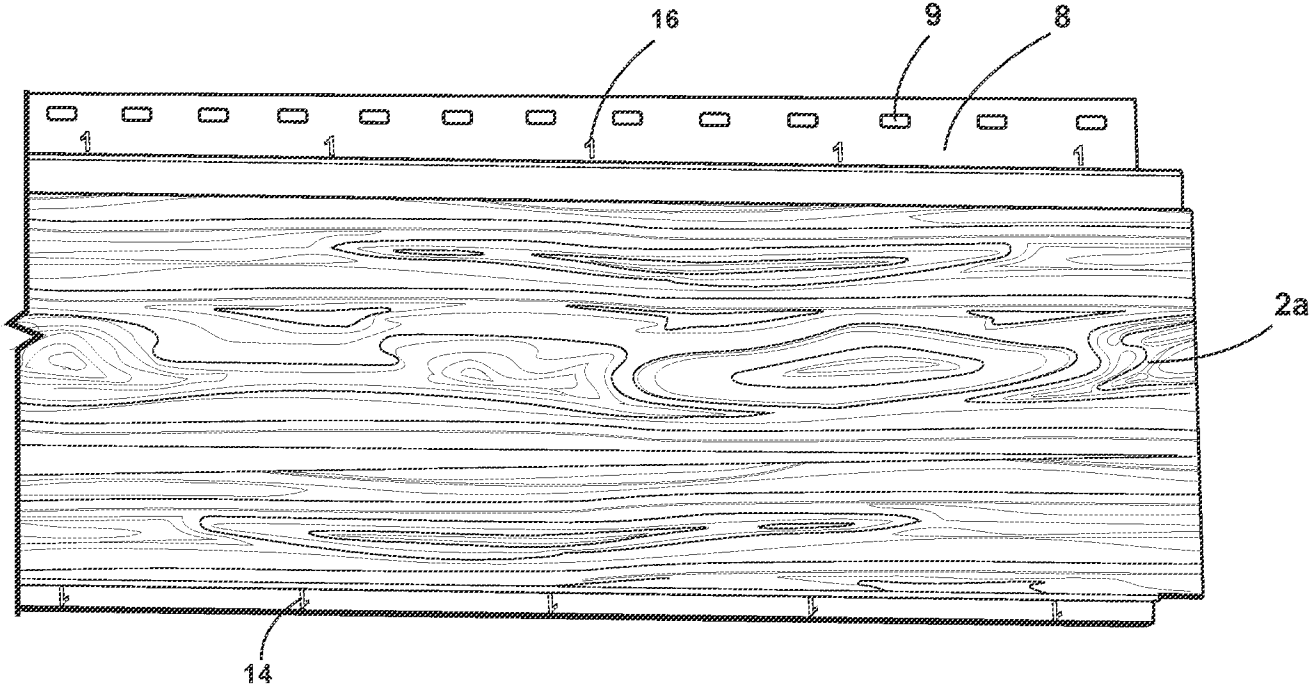
FIG. 3 is a partial front perspective view of the siding panel shown in FIG. 2 formed with the panel design being rotated 180°.
Figure 4:
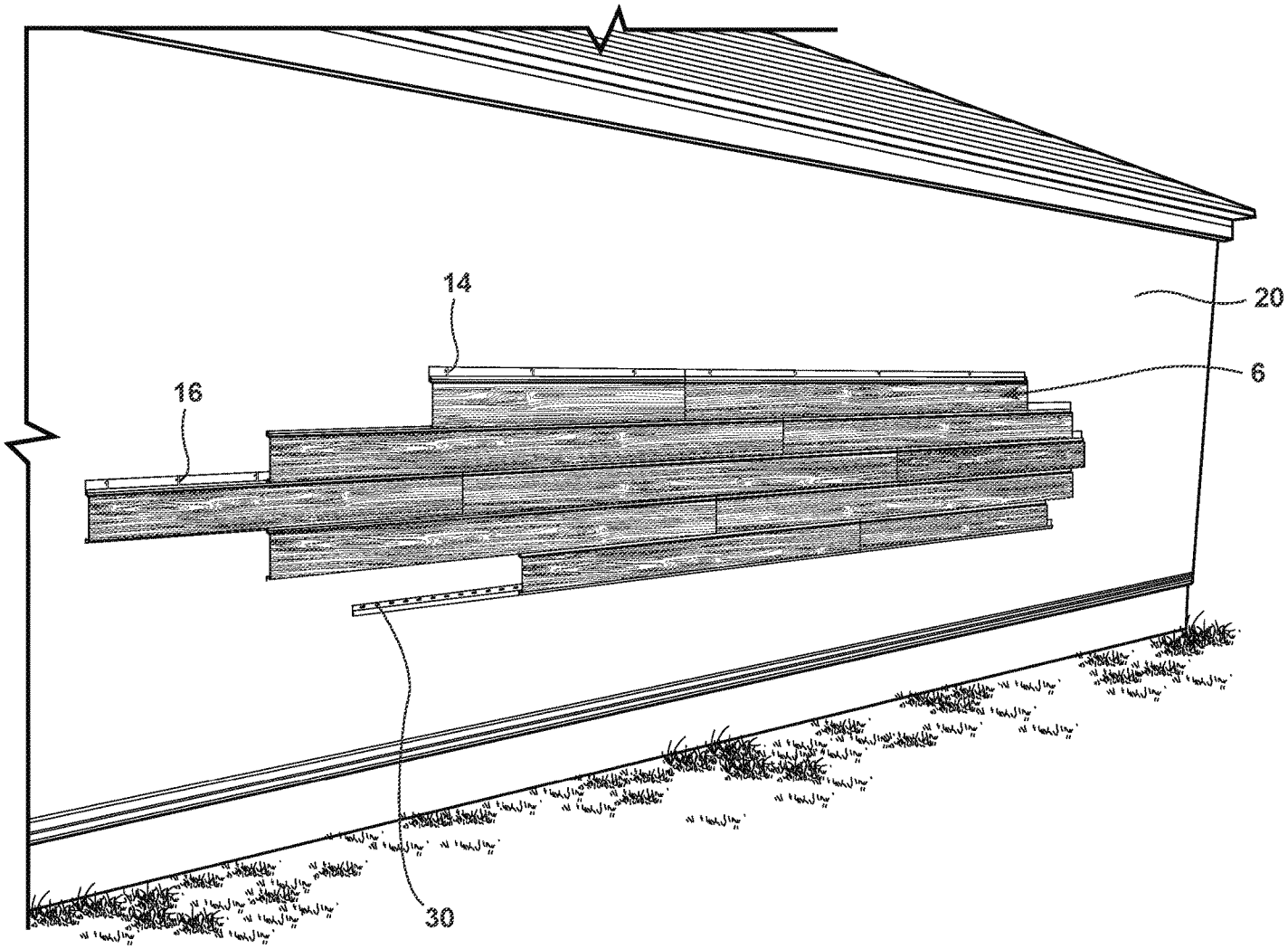
FIG. 4 is a partial side perspective view of a number of siding panels in one embodiment of the present invention installed on the side of a building.

Once the metal coil 4 has been painted, the metal coil 4 can be cut to length. In the illustrated example, the metal coil 4 would also be cut into six different widths, one for each panel design 2*a*-2*f*. Each panel design 2*a*-2*f* would then be placed into one or more pieces of roll forming equipment to form the portions of the panel 6. In the embodiment illustrated in FIG. 2, the top portion of the panel 6 has a securing flange 8 and the bottom portion of the panel 6 has a tab 10. The securing flange 8 of the panel 6 can have a plurality of openings 9 for fasteners and can also have a stiffening ridge (not shown) to enhance the rigidity of the panel 2. The tab portion 10 can fit into a groove that is formed in the upper portion of the panel 6 between the face 12 of the panel 6 and the securing flange 8. The panel 6 can also have an optional secondary face 13 that is generally recessed behind, but generally parallel to the face 12 of the panel 6.

The first indicia 14 and the second indicia 16 on the individual panel designs 2*a*-2*f* permit the 180° rotation of an individual section of panel design 2*a*-2*f* in the panel forming process to essentially create two finished panels 6, differing in appearance, from the same panel design 2*a*-2*f*. For example, with respect to the first panel design 2*a*, the panel can be inserted with the first indicia 14 to be formed as part of the securing flange 8, while a subsequent section of the same first panel design 2*a* can be inserted with the second indicia 16 to be formed as part of the securing flange 8.

Figure 5:
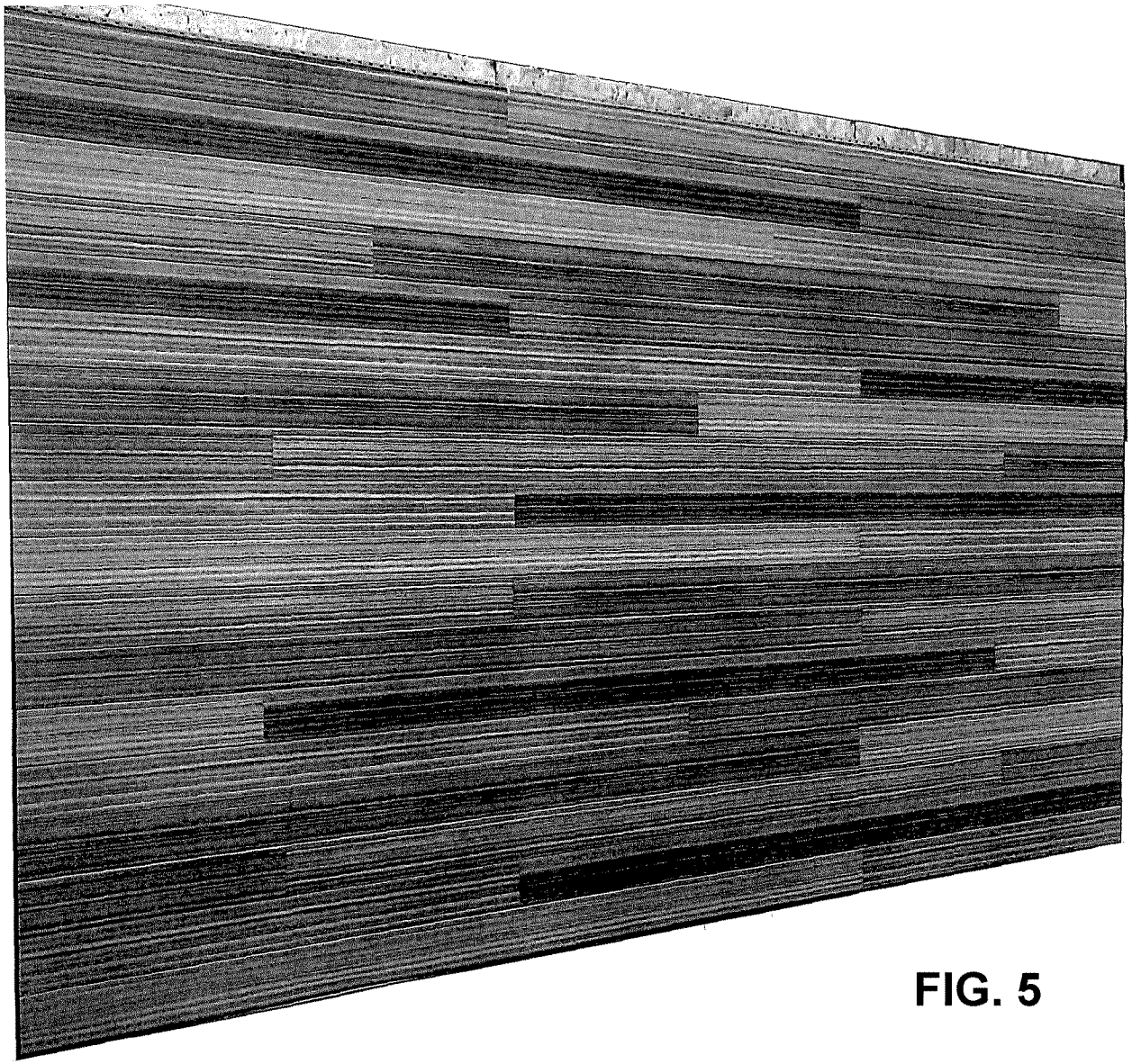
FIG. 5 is a front perspective image of a number of siding panels, made from the artwork shown in FIG. 1, coupled together.

When the panels 6 are installed on the side of a building 20, the first indicia 14 and the second indicia 16 permit the installation of panels 6 in a more diversified appearance on the building 20. Thus, in the image shown in FIG. 5, while the artwork 2 for the metal coil 4 was painted with six different panel designs 2*a*-2*f*, the formation of the panel 6 from the same printed metal coil 4 can result in twelve different looking panels 6. Those twelve different looking 6 can then be positioned on the side of a building 20 to give the building the look of using multiple, different pieces of panels 6.

While the illustrated embodiment show the panels 6 installed in a generally horizontal orientation on the building 20, the panels 6 can be installed vertically and/or on an angle on a surface of building 20. The panels 6 could also be used as ceiling or soffit on the lower side of a flat or angled roof, room, or porch.

Those skilled in the art will recognize, or will be able to ascertain using no more than routine experimentation, many equivalents to the specific embodiments of the invention described herein. Such equivalents are intended to be encompassed by the following claims.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

It will be understood by one having ordinary skill in the art that construction of the present disclosure and other components is not limited to any specific material. Other exemplary embodiments of the disclosure disclosed herein may be formed from a wide variety of materials, unless described otherwise herein.

It is also important to note that the construction and arrangement of the elements of the present disclosure as shown in the exemplary embodiments is illustrative only. Although only a few embodiments of the present innovations have been described in detail in this disclosure, those skilled in the art who review this disclosure will readily appreciate that, unless otherwise described, many modifications are possible (e.g., variations in sizes, dimensions, structures, shapes, and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating positions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

The invention claimed is:

1. A method of forming a plurality of siding panels, comprising:

painting at least one image on a metal coil;

painting a first indicia on said metal coil outside of a first section of said at least one image and painting a second indicia on said metal coil outside of a second section of said at least one image, wherein the first and second sections extend parallel to one another and are located on opposite sides of the image;

forming said metal coil into two or more siding panels such that said first indicia is on a securing flange of a first siding panel of the two or more siding panels and said second indicia is on an oppositely disposed tab of the first siding panel and said second indicia is further on a securing flange of a second siding panel of the two or more siding panels and said first indicia is further on an oppositely disposed tab of the second siding panel;

wherein said first indicia includes a plurality of spaced apart indicia;

wherein said second indicia includes a second plurality of spaced apart indicia; and wherein said first indicia and said second indicia are positioned on a same plane as a portion of the metal coil that is in between the plurality of spaced apart indicia of the first indicia and the plurality of spaced apart indicia of the second indicia.

2. The method of forming a siding panel of claim 1, wherein said first indicia and second indicia are numerical symbols.

3. The method of forming a siding panel of claim 2, wherein said first indicia and second indicia are a mirror images of each other.

4. The method of forming a siding panel of claim 1, wherein said image is a woodgrain pattern.

5. The method of forming a siding panel of claim 1, wherein the metal coil is a single piece.

6. The method of forming a siding panel of claim 1, wherein said metal coil includes steel.

7. The method of forming a siding panel of claim 1, wherein said painting of at least one image is done with a series of rollers.

* * * * *